United States Patent [19]

Knüppel et al.

[11] 4,047,707

[45] Sept. 13, 1977

[54] PROCESS AND CONVERTER FOR REFINING LIQUID METALS

[75] Inventors: Helmut Knüppel; Karl Brotzmann; Hans Georg Fassbinder, all of Sulzbach-Rosenberg, Germany

[73] Assignee: Eisenwerk-Gesellschaft Maximilianshutte mbH, Sulzbach-Rosenberg, Germany

[21] Appl. No.: 694,413

[22] Filed: June 9, 1976

Related U.S. Application Data

[60] Continuation of Ser. No. 501,008, Aug. 27, 1974, abandoned, which is a division of Ser. No. 402,695, Oct. 2, 1973, Pat. No. 3,920,448.

[30] Foreign Application Priority Data

Oct. 3, 1972 Canada ..... 153166/72

[51] Int. Cl.[2] ..... C21C 5/48

[52] U.S. Cl. ..... 266/222; 266/268; 266/245

[58] Field of Search ..... 75/60; 266/218, 220–224, 266/241, 243, 245–247, 265–270

[56] References Cited

U.S. PATENT DOCUMENTS

| | | | |
|---|---|---|---|
| 51,398 | 12/1865 | Bessemer | 266/223 |
| 358,559 | 3/1887 | Laureau | 266/224 |
| 484,770 | 10/1892 | Baldwin | 75/60 |
| 517,939 | 4/1894 | Stickney | 266/245 |
| 3,706,549 | 12/1972 | Knuppel et al. | 266/245 |

*Primary Examiner*—Gerald A. Dost
*Attorney, Agent, or Firm*—Lawrence I. Field

[57] ABSTRACT

An improvement in the refining of molten metals in a converter by means of oxygen introduced into the metal through tuyeres which include two concentric pipes, oxygen being passed into the melt through the central pipe and a protective fluid being passed into the melt as a sheath or screen around the oxygen, through the clearance space between the two pipes. In the present invention two tuyeres, disposed horizontally and each passing through the convertor sidewall permit refining to be accomplished without any slopping or splashing of the melt and with only minor wear of the convertor lining.

3 Claims, 1 Drawing Figure

PROCESS AND CONVERTER FOR REFINING LIQUID METALS

Figure 1:
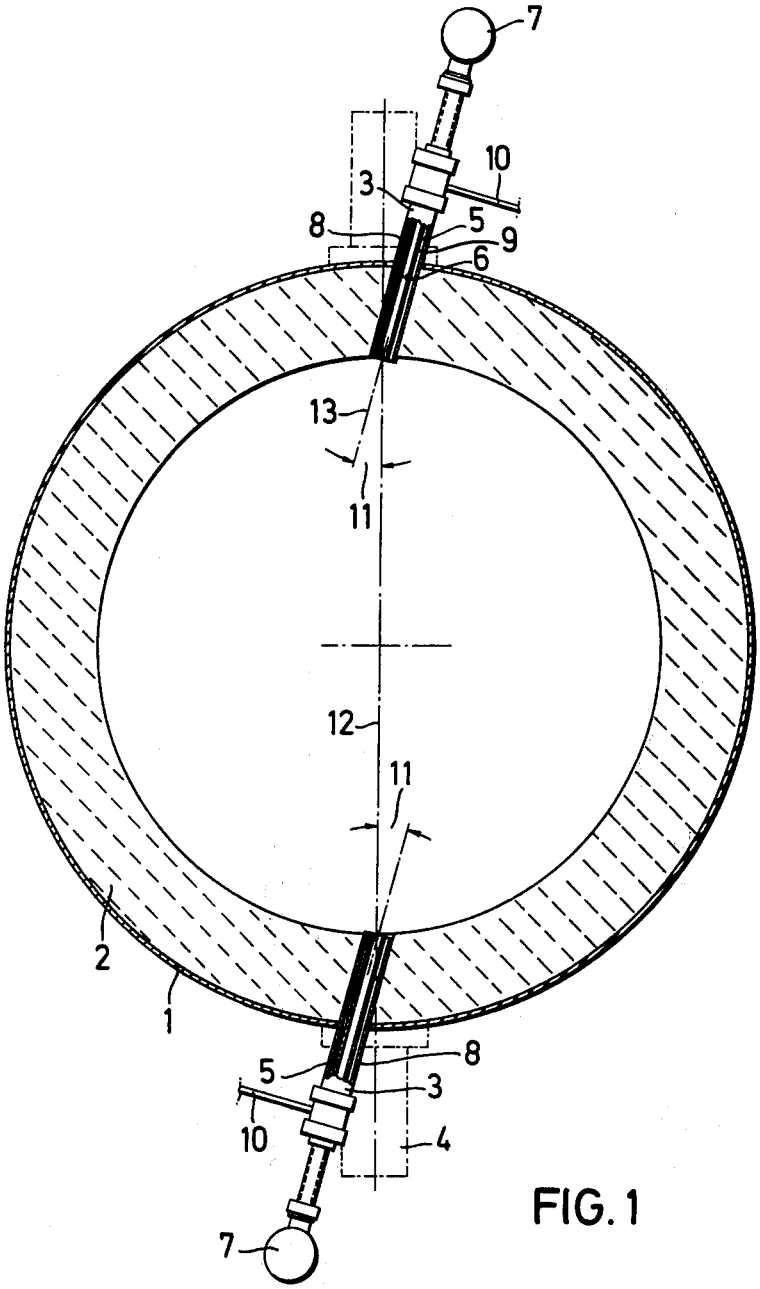

This is a continuation of application Ser. No. 501,008, filed Aug. 27, 1974, now abandoned, which is a division of U.S. patent application Ser. No. 402,695, filed Oct. 2, 1973, and now issued as U.S. Pat. No. 3,920,448, on Nov. 18, 1975.

The invention relates to a process for refining molten metals in vessels lined with refractory materials, by the use of oxygen surrounded by gaseous or liquid hydrocarbons and introduced through the side masonry of the vessel and underneath the surface of the molten metal, and to the convertor wherein such a process is achieved.

A process wherein oxygen surrounded by a protective veil of hydrocarbon is introduced below the bath surface for refining metal melts is described in U.S. Pat. No. 3,706,549 issued Dec. 19, 1972. This process makes use of tuyeres mounted in various groupings in the convertor bottom for refining pig iron into steel. The present invention is an improvement over the process of said patent, the disclosure of which is intended to be incorporated herein as representing the prior art.

Although the process is presently enjoying commercial success, various difficulties have been experienced from time to time in carrying out the process. In the use of such a convertor it is found that frequently the blowing will be quite agitated and that further there may be ejection of slag and steel jets the moment the bath level reaches the area of the tuyeres when tilting the convertor, e.g. for purposes of making additions or for taking samples.

The present invention is directed to retaining the advantages of refining by means of oxygen tuyeres mounted below the bath surface while further developing the process so as to obtain quiet blowing, minor wear of the refractory lining and high filling efficiency and to the means by which this is achieved.

Surprisingly, it was found that the desired improvements were obtained by mounting at least two tuyeres laterally in such manner that the kinetic energies of the media blown in or otherwise introduced through the tuyeres are partly eliminated. Preferably the tuyeres will be horizontal when the vessel is in the refining position.

The preferred arrangement of tuyeres comprises one pair oppositely located on the sidewalls of the refining vessel and provides special advantages in controlling the bath motion. If the tuyeres are directly and oppositely aligned with each other, the kinetic energy of the fluids discharged by the tuyeres will be nearly entirely eliminated and a horizontal rotational motion of the melt will be avoided. If the tuyeres are mounted at an angle with respect to the straight line connecting them, the metal bath may be subjected to a rotational impulse. This leads to a horizontal bath circulation in the refining vessel. In this kind of arrangement, the tuyeres may deviate in direction no more than 20° from the straight line connecting them. If this value is exceeded, an undesirably large bath rotation will occur, which causes rapid wear of the side-wall masonry of the convertor vessel lining.

By properly selecting the angle at which the tuyeres will be set with respect to their straight line connection, and taking into account the size of the convertor and its filling level, bath motion may be controlled. A moderate bath rotation is set for the refining process of the invention. This rotation enhances quiet blowing and prevents ejection and spattering during refining. Furthermore, this rotation causes an equalization of concentration of constituents in the melt, which is favorable to the refining.

Especially for symmetrical convertors with shapes such as that shown in FIGS. 8 and 9 of U.S. Pat. No. 3,706,549 there are particular advantages in the pairwise arrangement of the refining tuyeres provided they are always built-in below the convertor trunnions or pivots. The height of the tuyere installation should be approximately 20–60 cm above bottom level for a newly prepared convertor. In addition to the controlled bath motion, there is also the advantage of high convertor filling efficiency for such built-in height, because the tuyeres will still emerge from and clear the bath even for great loads when the convertor is in the horizontal convertor position, that is, during discharge and sampling. This permits utilization of relatively small convertor volume of the order of magnitude of 0.6 $m^3$/ton of steel, whereas for otherwise equal conditions and when the refining gas tuyeres are located in the convertor bottom, a convertor volume exceeding 0.8 $m^3$/ton of steel is usually required.

The oppositely arrayed tuyeres provide special advantages as regards lining life, since this arrangement prevents the media blown-in with high kinetic energies or high speeds of flow from impinging on the convertor wall opposite the tuyere. When making use of a single tuyere, the convertor wall located opposite to the tuyere is subjected to rapid wear on account of the unbraked kinetic energy of the refining gas jet.

The invention will be more clearly understood from the description which follows taken in conjunction with the drawings in which:

FIG. 1 is a horizontal view partly in section of a symmetrical convertor, taken in the plane of the tuyeres.

The convertor shown in FIG. 1 consists of a steel plate casing 1 lined with a solid refractory masonry 2. Tuyeres 3 are mounted below trunnions 4 shown in dashed lines and located in a plane above the tuyeres. Each of the tuyeres consists of two concentric pipes 5 and 8. The inner pipe 5 is preferably made of stainless steel and may be lined with a coating of abrasion-resistant ceramic layer 6. Oxygen alone or oxygen loaded with lime dust is fed from a supply line 7 through inner pipe 5. Pipe 5 is concentrically surrounded by an ordinary steel outer pipe 8. A protective medium consisting of gaseous or liquid hydrocarbons is introduced through the annular slit 9 between pipes 5 and 8 into the convertor. The angle 11 subtended by line 12 directly connecting the mouths of the tuyeres 3 of each tuyere pair and the longitudinal tuyere axis 13 indicates the built-in orientation of each of the pair of tuyeres. Line 12 may be a plane through the longitudinal axis of the convertor vessel and containing the trunnion axis.

EXAMPLE 1

A convertor with a capacity of 200 tons of crude steel was used. The inside diameter of the convertor was 5.5 m, the height was 5.8 m, and the capacity of the convertor was 124 $m^3$. The specific convertor volume obtained from these values is 0.62 $m^3$/ton of crude steel. A pair of oppositely located tuyeres was built into the lower side wall of the convertor in a plane 60 cm above the convertor bottom. Immediately underneath the trunnions, the two tuyeres were in horizontal position and made an angle of 10° with respect to the convertor diameter. The convertor masonry may be made thicker by some 20 cm in the region of the tuyere orifices, to prolong the life of a campaign.

The tuyeres each consisted of two concentric pipes, the inner one being coated with a wear-resistant ceramic so as to protect it against abrasion when lime-dust loaded oxygen is being passed through. The internal diameter of the pipe introducing the refining gas was 90 mm. The width of the annular slit between the inner and outer pipes was 2 mm. The oxygen was passed through the inner pipe at the rate of 50,000 N $m^3$/hr (cubic meters measured at standard pressure and temperature) and at a pressure of 10 atm. gauge. On the average, the oxygen was loaded with about 1.2 kg/$m^3$ of oxygen of lime dust during the refining time. Natural gas at the rate of 2,500 N $m^3$/hr and at a pressure of 8 atm. gauge was introduced into the vessel through the annular slit as the protective medium. The natural gas consisted of about 90% methane, 8% other hydrocarbons and 2% nitrogen. The convertor was loaded with 150 tons of pig iron of the following composition:

4.2% carbon
0.9% silicon
0.6% manganese
0.15% phosphorus
0.05% sulfur
balance — iron and 70 tons of scrap was charged. The charge was refined to steel within 12 minutes, the steel being of the following composition:

0.03% carbon
0.15% manganese
0.008% phosphorus
0.022% sulfur
0.0025% nitrogen
balance — iron Observation of the refining of a large number of melts has shown that the metal melt will rotate about the convertor longitudinal axis when the tuyeres are located as described above (10° inclination). Local wear at the lower side wall, such as had been observed for larger angles of inclination of the tuyeres, were not observed in the arrangement mentioned. Neither spattering nor ejection were observed during refining. On the whole, blowing was quiet.

EXAMPLE 2

A convertor for refining an 80-ton melt was used. The convertor had a capacity of 50 $m^3$. The inside dimensions were 4 meters for the diameter and 5 meters for the height. A pair of oppositely located tuyeres was mounted horizontally underneath the tilting axis of the convertor and 50 cm above the bottom. The tuyeres were mounted so as to subtend only a small angle of about 5° with respect to their direct connecting line. Each tuyere consisted of an inner copper pipe 5, having an internal diameter of 56 mm and of a concentric outer pipe 8 made of steel. Between the pipes an annular slit of 0.75 mm existed permitting flow of light fuel oil which served as protective medium; about 360 liters/hr of the light oil passed through the slit, the pressure being about 3 atm. gauge, and 10,000 N $m^3$/hr of oxygen at a gauge pressure of 10 atm. was passed through the inner pipe 5 of each tuyere. A pig iron of the following composition was refined:

3.6% carbon
1.6% phosphorus
0.3% silicon
0.3% manganese
0.04% sulfur
balance essentially iron.

55 tons of this pig iron together with 25 tons of scrap and 8 tons of lump lime were loaded into the convertor. After about 11 minutes, crude steel of the following composition was obtained:

0.02% carbon
0.025% phosphorus
0.08% manganese
0.025% sulfur
balance essentially iron In this example too there was very quiet blowing, free from ejections, compared to an ordinary bottom blown convertor.

Having now described preferred embodiments of this invention in accordance with the Patent Statutes, it is not intended that it be limited except as may be required by the following claims.

We claim:

1. In a refractory, masonry lined tiltable refining vessel with a pivot and a nearly circular horizontal cross section wherein oxygen surrounded by fluid hydrocarbons is introduced into a bath of molten metal to be refined in said vessel through tuyeres each of which includes an inner pipe for the oxygen and an outer pipe concentric with the inner pipe, the space between said pipes being for the introduction of said hydrocarbons, the improvement which comprises:

mounting two of said tuyeres in the refractory masonry in said vessel opposite to one another and below the pivot of said vessel;

each of said tuyeres being located in the side wall of said vessel and being disposed horizontally when the vessel is in the refining position and being inclined with respect to a vessel diameter straight line connecting the orifice of each of said two tuyeres so that the angle subtended by each tuyere, with respect to said straight line connecting the orifice of each tuyere to the orifice of the opposing tuyere does not exceed 20°.

2. A convertor as defined in claim 1 wherein said tuyeres in the refining vessel are mounted approximately 20–60 cm above the bottom level of the vessel.

3. A convertor as defined in claim 1 wherein the refractory lining provided in the region of the tuyeres is approximately twice as thick as beyond that region.

* * * * *